US007309290B2

(12) United States Patent
Hutchison

(10) Patent No.: US 7,309,290 B2
(45) Date of Patent: Dec. 18, 2007

(54) PUTTING TARGET

(76) Inventor: Earl C. Hutchison, 2517 Deerpath Dr., Nashville, TN (US) 37217

( * ) Notice: Subject to any disclaimer, the term of this patent is extended or adjusted under 35 U.S.C. 154(b) by 0 days.

(21) Appl. No.: 11/433,475

(22) Filed: May 15, 2006

(65) Prior Publication Data

US 2006/0276255 A1 Dec. 7, 2006

Related U.S. Application Data

(60) Provisional application No. 60/686,044, filed on Jun. 1, 2005.

(51) Int. Cl.
*A63B 69/36* (2006.01)

(52) U.S. Cl. ..... 473/180

(58) Field of Classification Search ..... 473/157–166, 473/171, 173, 174, 180–196
See application file for complete search history.

(56) References Cited

U.S. PATENT DOCUMENTS

| | | | | |
|---|---|---|---|---|
| 1,656,739 | A * | 1/1928 | Kurtz | 473/184 |
| 1,784,863 | A | 12/1930 | Busse | |
| 1,874,873 | A | 8/1932 | Boye | |
| 1,979,584 | A * | 11/1934 | Thompson | 473/185 |
| 2,081,511 | A * | 5/1937 | Smith | 473/185 |
| 2,810,580 | A * | 10/1957 | Johnson | 473/185 |
| 3,097,849 | A * | 7/1963 | Rice | 473/185 |
| 3,275,325 | A | 9/1966 | Mackenzie | |
| 3,603,594 | A | 9/1971 | Kelley | |
| 3,722,889 | A * | 3/1973 | Miller | 473/169 |
| 4,691,923 | A | 9/1987 | Schwartz | |
| 4,861,033 | A * | 8/1989 | Miner | 473/180 |
| 5,131,658 | A * | 7/1992 | Grenon | 473/185 |
| 5,139,262 | A * | 8/1992 | Lai | 473/181 |
| 5,390,926 | A | 2/1995 | Hanson et al. | |
| 5,505,451 | A | 4/1996 | Brayshaw | |
| 5,573,247 | A * | 11/1996 | Ridge | 473/184 |
| 6,179,722 | B1 * | 1/2001 | Bond | 473/180 |
| 6,302,803 | B1 | 10/2001 | Barlow | |
| 6,623,373 | B2 | 9/2003 | Carlton et al. | |

* cited by examiner

*Primary Examiner*—Mark S Graham
(74) *Attorney, Agent, or Firm*—Richard C. Litman

(57) ABSTRACT

The preferred embodiment of the putting target includes a rectangular base portion, a circular center depression, a center fencing wall, at least one overrun depression, and at least one overrun fencing wall. The circular center depression is formed in a raised upper surface of the base portion and simulates an actual golf hole. The center fencing wall, overrun depression or depression and overrun fencing wall or walls act to affect and collect golf balls that have been putted toward the putting target with the incorrect speed or precision. The putting target may be included in a kit that includes one or more putting mats with each putting mat defining a putting surface and each putting surface defining a selected texture to simulate actual putting conditions. The putting target may also be used to play a competitive putting game.

7 Claims, 6 Drawing Sheets

PUTTING TARGET

CROSS-REFERENCE TO RELATED APPLICATION

This application claims the benefit of U.S. Provisional Patent Application Ser. No. 60/686,044, filed Jun. 1, 2005.

BACKGROUND OF THE INVENTION

1. Field of the Invention

The present invention relates to golf accessories, and more specifically to a golf putting target.

2. Description of the Related Art

The use of practice putting devices has become an increasingly popular means for a golfer to practice his putting away from the golf course. Learning to control the ball when putting is extremely difficult. Each green on a golf course is typically configured to challenge the golfer. When using a practice putting device, it is desirable that the device simulate a golf course putting green as closely as possible. For example, the texture of the practice putting surface should be similar to that of a typical putting green. Further, the practice putting device should have a topography that simulates the actual contours and other conditions that affect a golf ball around a golf hole and provide a variety of challenging putts.

What is needed is a golf putting practice device that can be used on a variety of different surfaces and can accurately simulate putting conditions that are most commonly seen on actual golf courses. It is desirable that the device be available as part of a kit along with one or more putting mats with putting surfaces that simulate actual putting greens. It is also desirable that the device provide a means for playing a competitive putting game. Thus, a putting target solving the aforementioned problems is desired.

SUMMARY OF THE INVENTION

The preferred embodiment of the putting target of the present invention includes a rectangular base portion, a circular center depression, a center fencing wall, at least one overrun depression, and at least one overrun fencing wall. The base portion has a lowered front edge, a lowered back edge and two lowered side edges defining a raised upper surface. The circular center depression is formed in the raised upper surface of the base portion at a point midway between the two lowered side edges substantially near the lowered front edge.

The center fencing wall is formed around a portion of the circular center depression and is open along the portion of the circular center depression adjacent to the lowered front edge of the base portion. The at least one overrun depression is formed in the raised upper surface of the base portion at a point nearer the lowered back edge of the rectangular base portion than the circular center depression. The least one overrun fencing wall is formed around a portion of the at least one overrun depression and is open along the portion of the at least one overrun depression facing to the lowered front edge of the rectangular base portion.

An alternate embodiment of a putting target of the present invention includes a rectangular base, a circular center depression, a fencing wall, and two circular offset depressions. The rectangular base portion has a front edge, a back edge and two side edges. The base portion has an upper surface and a lower surface, the upper surface defining the back edge and two side edges of the rectangular base and the lower surface defining the front edge of the rectangular base. The front edge slopes in a direction opposite the back edge as to form a ramp.

The circular center depression is formed in the lower surface of the rectangular base portion at a point midway between the two side edges of the rectangular base portion substantially near the front edge. The fencing wall is formed around a portion of the circular center depression and is open along the portion of the circular center depression adjacent to the front edge of the rectangular base portion. The two circular offset depressions are formed in the lower surface of the rectangular base portion at points nearer the back edge of the rectangular base than the circular center depression.

The putting target may be included in a kit that includes one or more putting mats. Each putting mat defines a putting surface and each putting surface defines a selected texture to simulate actual putting conditions. The putting target may also be used to play a competitive putting game, whereby players are increasingly rewarded for putts that come closest to, or go in the circular center depression.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
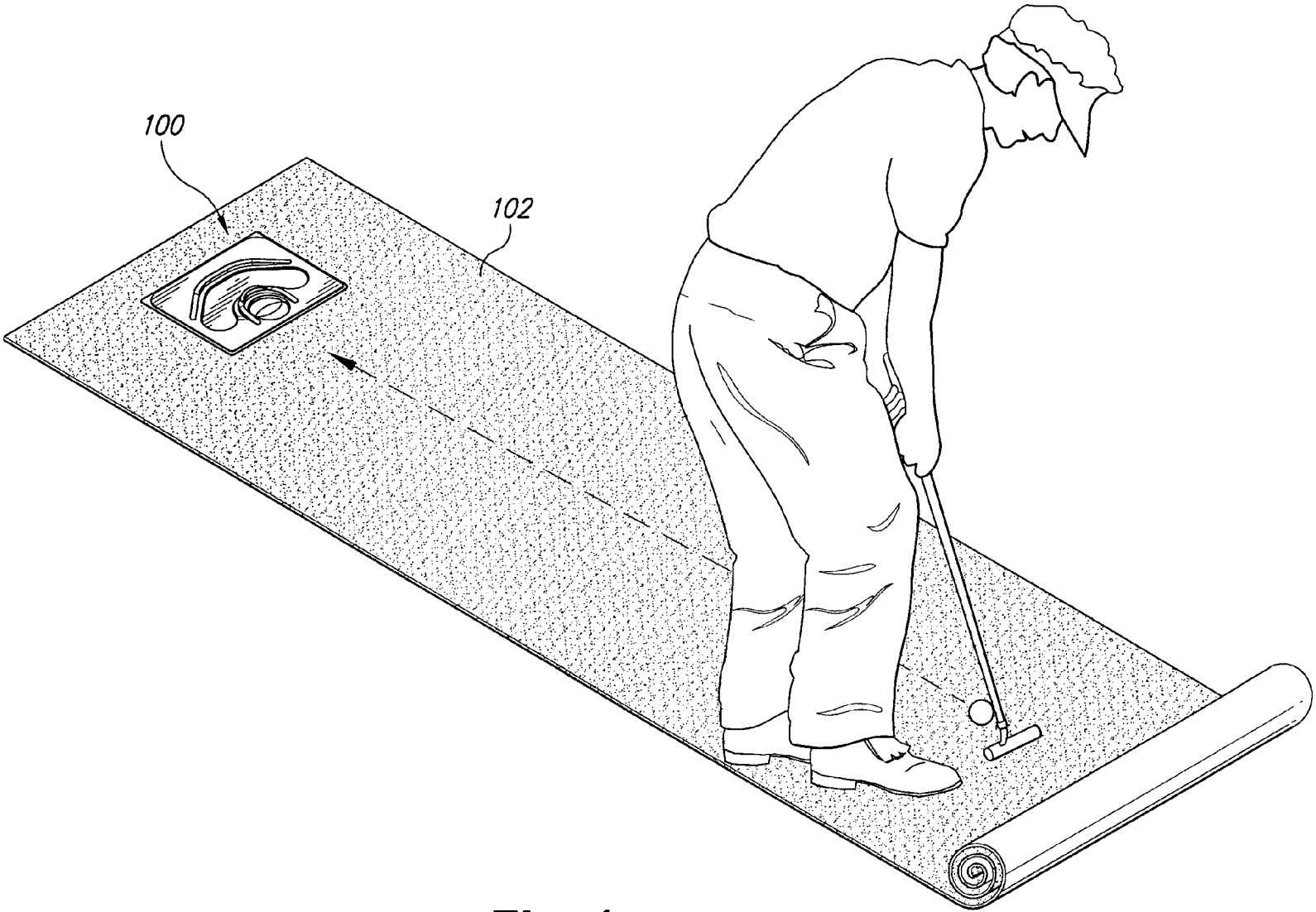
FIG. 1 is an environmental, perspective view of a preferred embodiment of a putting target according to the present invention.
Figure 2:
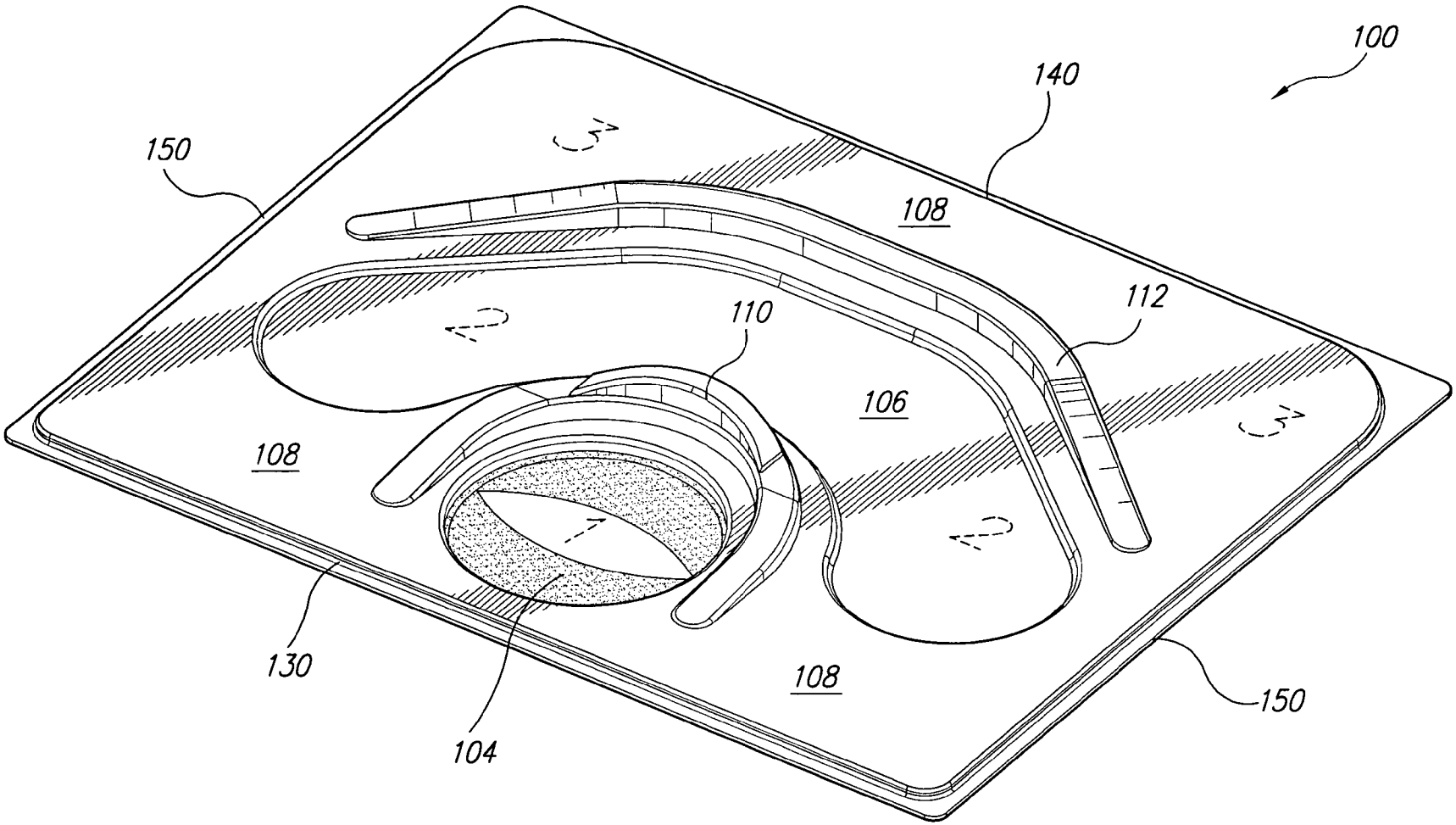
FIG. 2 is a perspective view of a preferred embodiment of a putting target according to the present invention.
Figure 3:
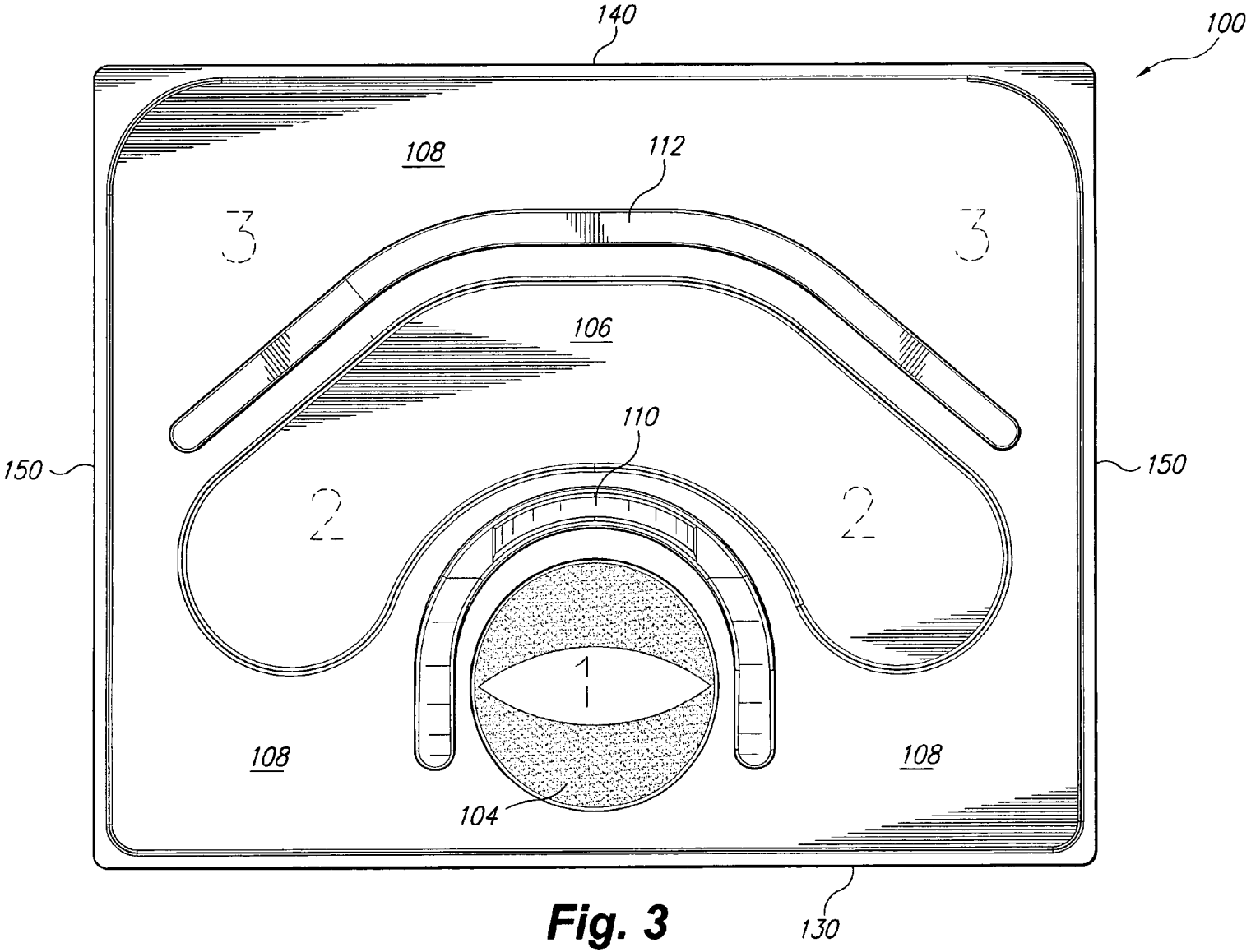
FIG. 3 is a top plan view of a preferred embodiment of a putting target according to the present invention.

The present invention is a golf putting target, of which a preferred embodiment is designated generally as 100 in FIGS. 1-3.

FIG. 1 shows golf putting target 100 in use with a putting mat 102. Golf putting target 100 may be provided as part of a kit including one or more putting mats 102. Each putting mat 102 has a putting surface having a selected texture to simulate actual putting conditions.

FIG. 2-3 show golf putting target 100 having a rectangular base portion having a lowered front edge 130, a lowered back edge 140 and two lowered side edges 150 defining a raised upper surface 108. A circular center depression 104 is formed in raised upper surface 108 of the rectangular base portion at a point midway between two lowered side edges 150 of the rectangular base portion substantially near lowered front edge 130. In a preferred embodiment, circular center depression 104 is dimensioned to simulate the opening of a conventional golf hole. Circular center depression 104 may also be shaded or color as to resemble an actual golf hole from a distance.

A center fencing wall 110 is formed around a portion of circular center depression 104, center fencing wall 110 being open along the portion of circular center depression 104 adjacent to lowered front edge 130 of the rectangular base portion. In the preferred embodiment, a single overrun depression 106 is formed in raised upper surface 108 of the rectangular base portion at a point nearer the lowered back edge 140 of the rectangular base portion than circular center depression 104. Overrun fencing wall 112 is formed around a portion of overrun depression 106, the overrun fencing wall 112 being open along the portion of overrun depression 106 facing to the lowered front edge 130 of the rectangular base portion.

As a general rule, golf balls putted toward golf putting target 100 will collect in and around golf putting target 100, simulating the movement of a golf ball around a traditional golf hole. Circular center depression 104 acts as a traditional golf hole and is the main target point for a user who is putting golf balls toward the golf putting target 100. A putted ball must be on line and putted at the right speed in order to collect within circular center depression 104. If the putted ball is on line, but moving too fast, the ball will travel through circular center depression 104 and over center fencing wall 110, leaving the ball to rest in overrun depression 106. If putted extremely fast, the ball may even traverse overrun fencing wall 112, leaving the ball to rest on raised upper surface 108 or even leave golf putting target 100 all together. If the putted ball is on line, but moving too slow, the ball will not make it over lowered front edge 130 and will be shuttled away from golf putting target 100. Putted balls that are not on line may do a number of things depending on the speed. Putted balls may collect in overrun depression 106, come to rest along raised upper surface 108, or not enter or remain on golf putting target 100 all together.

A competitive game may also be incorporated into golf putting target 100. For example, differing point values may be assigned to the different locations on golf putting target 100. A point value can be assigned for circular center depression 104, overrun depression 106, raised upper surface 108, and off the golf putting target 100. Each competitor may be required to play a certain number of rounds, with the winner being the competitor who scored the least, or even the most, amount of points.

Figure 4:
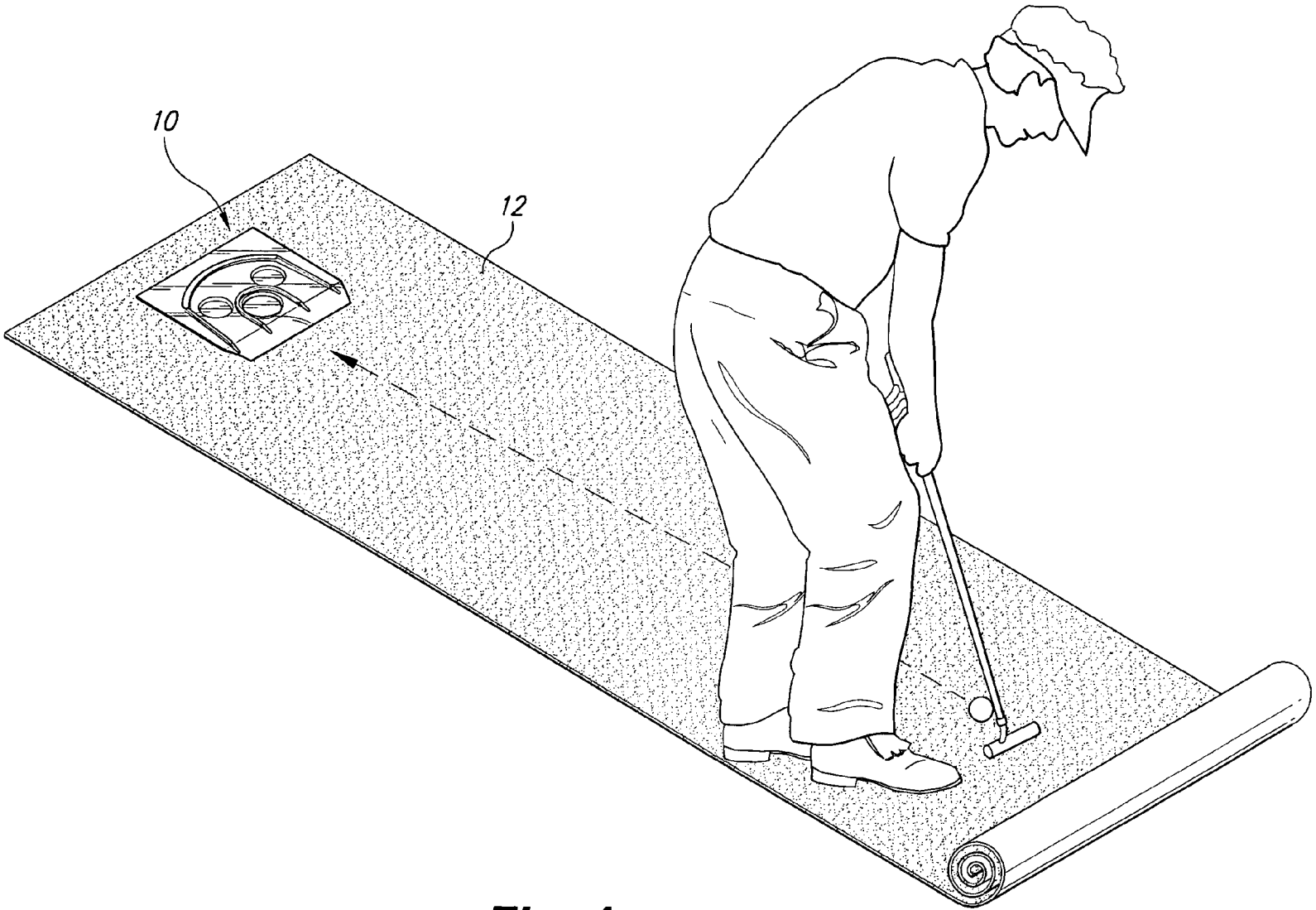
FIG. 4 is an environmental, perspective view of an alternate embodiment of a putting target according to the present invention.
Figure 5:
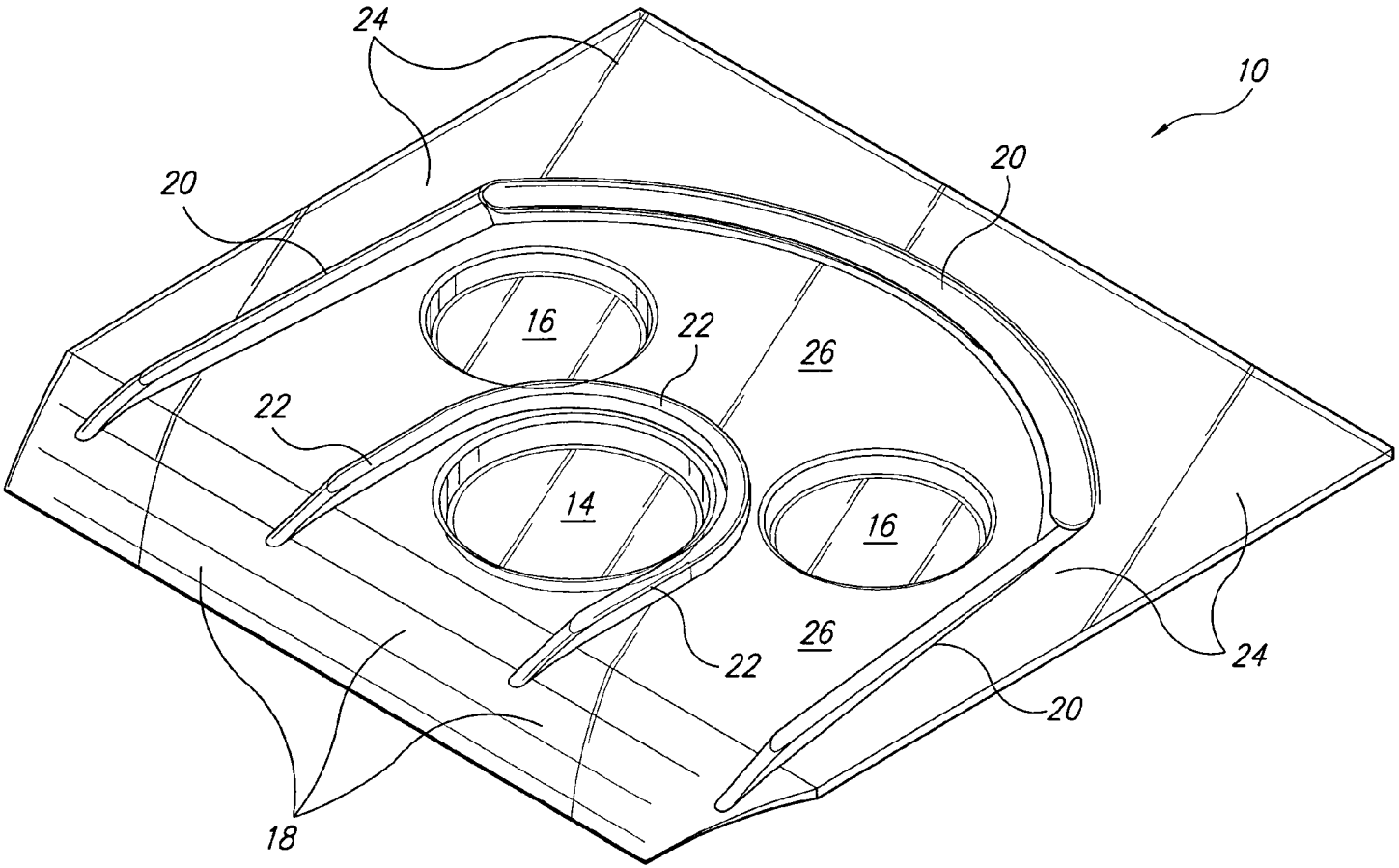
FIG. 5 is a perspective view of an alternate embodiment of a putting target according to the present invention.
Figure 6:
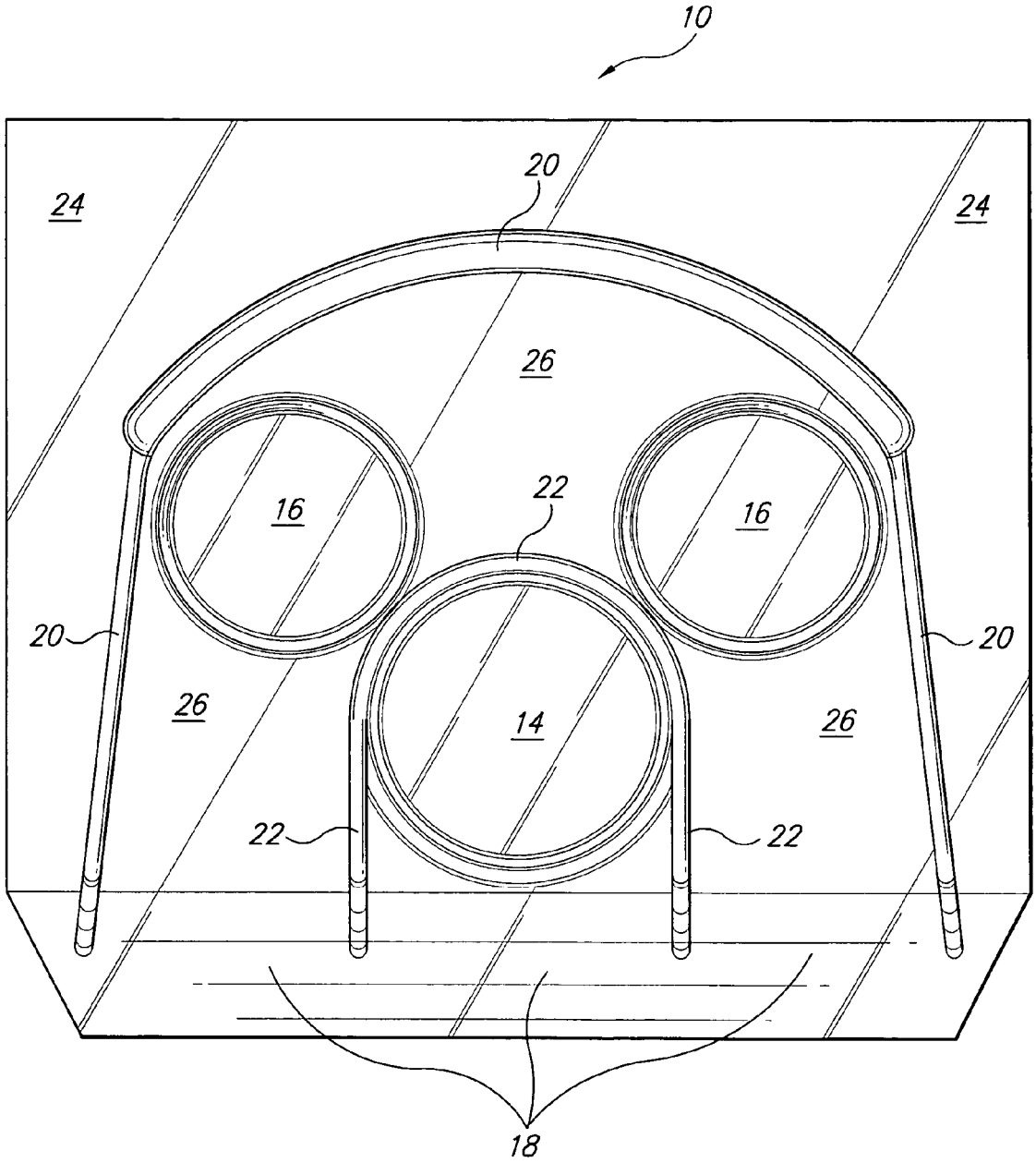
FIG. 6 is a top plan view of an alternate embodiment of a putting target according to the present invention.

FIGS. 4-6 show an alternate embodiment of golf putting target 10. FIG. 4 shows golf putting target 10 in use with a putting mat 12. Golf putting target 10 may be provided as part of a kit including one or more putting mats 12. Each putting mat 12 has a putting surface having a selected texture to simulate actual putting conditions.

FIG. 5-6 show golf putting target 10 having a rectangular base portion with a front edge, a back edge and two side edges. The base portion has an upper surface 24 and a lower surface 26, with upper surface 24 and lower surface 26 being separated by vertical wall 20. The upper surface 24 defines the back edge and two side edges of golf putting target 10, while the lower surface defines the front edge of golf putting target 10. The front edge slopes in a direction opposite the back edge to form ramp 18. Ramp 18 allows a golf ball that has been putted in the direction of golf putting target 10 to enter golf putting target 10.

Circular center depression 14 is formed in lower surface 26 of the rectangular base portion at a point midway between the two side edges of the rectangular base portion substantially near the front edge. Preferably, circular center depression 14 is dimensioned to simulate the opening of a conventional golf hole. Fencing wall 22 is formed around a portion of circular center depression 14. Fencing wall 14 is open along the portion of circular center depression 14 adjacent to ramp 18, generally allowing a putted ball access to circular center depression 14 only adjacent to ramp 18. Fencing wall 22 can be varied in height in and thickness in order to most closely simulate the contours of a putting green around a traditional golf hole.

Two circular offset depressions 16 are formed in lower surface 26 of the rectangular base portion at points nearer the back edge of the rectangular base portion than the circular center depression 14.

As a general rule, golf balls putted toward golf putting target 10 will collect in and around golf putting target 10, simulating the movement of a golf ball around a traditional golf hole. Circular center depression 14 acts as a traditional golf hole and is the main target point for a user who is putting golf balls toward the golf putting target 10. A putted ball must be on line and putted at the right speed in order to collect within circular center depression 14. If the putted ball is on line, but moving too fast, the ball will travel through circular center depression 14, and over fencing wall 22, leaving the ball to rest in the rear portion of lower surface 26. If putted extremely fast, the ball may even traverse vertical wall 20, leaving the ball to rest on upper surface 24 or even leave golf putting target 10 all together. If the putted ball is on line, but moving too slow, the ball will not make it up ramp 18 and will be shuttled away from golf putting target 10. Putted balls that are not on line may do a number of things depending on the speed. Putted balls may collect in circular offset depressions 16, come to rest along lower surface 26, come to rest along upper surface 24, or not enter or remain on golf putting target 10 all together.

A competitive game may also be incorporated into golf putting target 10. For example, differing point values may be assigned to the different locations on golf putting target 10. A point value can be assigned for circular center depression 14, circular offset depressions 16, lower surface 26, upper surface 24, and off the golf putting target. Each competitor may be required to play a certain number of rounds, with the winner being the competitor who scored the least, or even the most, amount of points.

It is to be understood that the present invention is not limited to the embodiments described above, but encompasses any and all embodiments within the scope of the following claims.

I claim:

1. A golf putting target, comprising:

a rectangular base portion having a lowered front edge, a lowered back edge and two lowered side edges defining a raised upper surface;

a circular center depression, the circular center depression formed in the raised upper surface of the rectangular base portion at a point midway between the two lowered side edges of the rectangular base portion substantially near the lowered front edge;

a center fencing wall formed around a portion of the circular center depression, the center fencing wall being open and at the level of the upper surface along the portion of the circular center depression adjacent to the lowered front edge of the rectangular base portion;

at least one overrun depression, the at least one overrun depression formed in the raised upper surface of the rectangular base portion thereby being at a lower level than the upper surface and at a point nearer the lowered back edge of the rectangular base portion than the circular center depression; and at least one overrun fencing wall, the at least one overrun fencing wall formed around a portion of the at least one overrun depression, the at least one overrun fencing wall being open along the portion of the at least one overrun depression facing to the lowered front edge of the rectangular base portion.

2. The golf putting target according to claim 1, wherein the circular center depression is dimensioned to simulate the opening of a conventional golf hole.

3. The golf putting target according to claim 2, wherein the at least one overrun depression comprises a single overrun depression, the single overrun depression adjacent to the center fencing wall.

4. The golf putting target according to claim 3, wherein the at least one overrun fencing wall comprises a single overrun fencing wall, the single overrun fencing wall formed around a portion of the single overrun depression, the single overrun fencing wall being open along the portion of the single overrun depression facing to the lowered front edge of the rectangular base portion.

5. A golf putting target, comprising:

a rectangular base portion having a front edge, a back edge and two side edges, the base portion having an upper surface and a lower surface separated by a vertical wall, the upper surface defining the back edge and two side edges, the lower surface defining the front edge, the front edge sloping in a direction opposite the back edge as to form a ramp;

a circular center depression, the circular center depression formed in the lower surface of the rectangular base portion at a point midway between the two side edges of the rectangular base portion substantially near the front edge;

a fencing wall formed around a portion of the circular center depression, the fencing wall being open and at the level of the lower surface along the portion of the circular center depression adjacent to the front edge of the rectangular base portion; and two circular offset depressions, the two circular offset depressions formed in the lower surface of the rectangular base portion thereby being at a lower level than the lower surface and at points nearer the back edge of the rectangular base portion than the circular center depression.

6. The golf putting target according to claim 5, wherein the circular center depression is dimensioned to simulate the opening of a conventional golf hole.

7. A kit for practicing golf putting, comprising:

one or more putting mats, each putting mat defining a putting surface, each putting surface defining a selected texture to simulate actual putting conditions; and a golf putting target, the golf putting target having a rectangular base portion having a lowered front edge, a lowered back edge and two lowered side edges defining a raised upper surface, a circular center depression, the circular center depression formed in the raised upper surface of the rectangular base portion at a point midway between the two lowered side edges of the rectangular base portion substantially near the lowered front edge, a center fencing wall formed around a portion of the circular center depression, the center fencing wall being open along the portion of the circular center depression adjacent to the lowered front edge of the rectangular base portion and at the level of the upper surface, at least one overrun depression, the at least one overrun depression formed in the raised upper surface of the rectangular base portion thereby being at a lower level than the upper surface and at a point nearer the lowered back edge of the rectangular base portion than the circular center depression, and at least one overrun fencing wall, the at least one overrun fencing wall formed around a portion of the at least one overrun depression, the at least one overrun fencing wall being open along the portion of the at least one overrun depression facing to the lowered front edge of the rectangular base portion.

* * * * *